US005083942A

United States Patent [19]

Hahn

[11] Patent Number: 5,083,942

[45] Date of Patent: Jan. 28, 1992

[54] FISH HOOK HOLD-DOWNS

[75] Inventor: Marlyn E. Hahn, York, Pa.

[73] Assignee: E. I. Du Pont de Nemours and Company, Wilmington, Del.

[21] Appl. No.: 654,854

[22] Filed: Feb. 13, 1991

[51] Int. Cl.[5] ..... H01R 13/73

[52] U.S. Cl. ..... 439/567; 439/571; 411/508

[58] Field of Search ..... 439/571, 557, 555, 554, 439/552, 553, 567, 82, 733, 751; 411/456, 508, 509, 510, 913

[56] References Cited

U.S. PATENT DOCUMENTS

| | | | |
|---|---|---|---|
| 2,136,498 | 11/1938 | Geyer | 439/751 |
| 2,596,940 | 5/1952 | Poupitch | 411/508 |
| 4,538,878 | 9/1985 | Dambach et al. | 339/217 |
| 4,618,209 | 10/1986 | Sonobe | 339/258 |
| 4,735,587 | 4/1988 | Kirayoglu | 439/82 |
| 4,907,987 | 3/1990 | Douthy et al. | 439/571 |

FOREIGN PATENT DOCUMENTS 7912573 8/1979 Fed. Rep. of Germany .

*Primary Examiner*—Gary F. Paumen

[57] ABSTRACT

The present invention relates to hold-downs for securing components to circuit assemblies and more particularly to fish hook hold-downs for securing connectors to printed circuit boards.

10 Claims, 4 Drawing Sheets

FISH HOOK HOLD-DOWNS

BACKGROUND OF THE INVENTION

1. Field of the Invention

This invention relates to hold-downs for securing components to circuit assemblies and more particularly to fish hook hold-downs for securing connectors to printed circuit boards.

2. Description of Related Art

Various apparatus exist for locating and securing connectors onto printed circuit boards (PCBs) prior to and during soldering of electrical terminals mounted in the connector to the circuit assembly.

Terminal pins of through-mount connectors have been configured to secure the connector to a PCB by causing an interference fit between press-fit sections of the terminals within plated-through holes in a PCB. For instance, U.S. Pat. No. 4,735,587 discloses a header with two rows of pins with selected opposed pin pairs having cantilever retention arms for engaging interior surfaces of circuit board holes to hold the header to a circuit board prior to and during soldering. The pins are held in the board holes merely by the interference fit between linear corners or edges of the pins against the wall of the board holes. The particular shape and orientation of the retention arms results in the need for a relatively high insertion force in order to press the pin into a hole.

Other hold-downs that are separate from the connector terminals have been disclosed or used for securing either surface-mount connectors or through-mount connectors to PCBs. See, for instance, U.S. Pat. No. 4,907,987 which discloses a boardlock for mounting a connector to a printed circuit board. A first portion of the boardlock is secured by an interference fit within a recess in the connector housing. Tabs define shoulders on the boardlock which prevent the housing from being separated from the boardlock. A pair of spring members extend from the first portion for insertion into a hole through the circuit board. Barbs on opposed surfaces of the spring members bite into the wall of the hole forming an interference fit between the boardlock and the circuit board. However, the retention force caused by the interference fit between this hold-down in a connector housing is low which may necessitate the use of a special seating tool to connect such a hold-down to a board.

It is an object of this invention to provide a hold-down terminal that can be used to hold down a connector on a printed circuit board at least while terminals mounted in the connector are soldered to the circuit board.

It is an object of this invention to provide the hold-down terminal such that it can be used to hold down either a through-mount connector or a surface mount connector onto a printed circuit board.

These and other objects of the invention will be clear from the following description.

SUMMARY OF THE INVENTION

This invention relates to a fish hook hold-down for holding a connector housing to a circuit assembly. The fish hook hold-down generally comprises a housing attaching portion, a substantially flat elongated strip and a circuit assembly attaching portion. The housing attaching portion is for securing to the connector housing. The substantially flat elongated strip is connected to the housing attaching portion. The strip has a first elongated substantially flat side, a second elongated substantially flat side, a first elongated flat edge and a second elongated flat edge. The edges interconnect the sides. The circuit assembly attaching portion is connected to the elongated strip. The circuit assembly attaching portion is for securing to the circuit assembly. The circuit assembly attaching portion comprises an end portion of the strip folded to have a fish hook configuration. The circuit assembly attaching portion comprises a flat tip, a first tapered flat edge, a second tapered flat edge, a bent elbow inner surface and a bent elbow outer surface. The first tapered flat edge intersects the flat tip and the first elongated flat edge. The second tapered flat edge intersects the flat tip and the second elongated flat edge. The bent elbow inner surface intersects the flat tip, the first elongated flat side, the first tapered flat edge and the second tapered flat edge. The bent elbow outer surface intersects the flat tip forming a linear barb. The bent elbow outer surface further intersects the second elongated flat side, the first tapered flat edge and the second tapered flat edge. When the fish hook hold-down is forced into a hole defined by a cylindrical wall through the circuit assembly such that the bent elbow outer surface is inserted first into the hole, the bent elbow outer surface, the first tapered flat edge and the second tapered flat edge contact the cylindrical wall forcing the tip towards the flat elongated strip causing an interference fit within the hole. If the fish hook hold-down is then forced in a direction opposite to the insertion direction, the linear barb digs into the cylindrical wall significantly deterring withdrawal.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
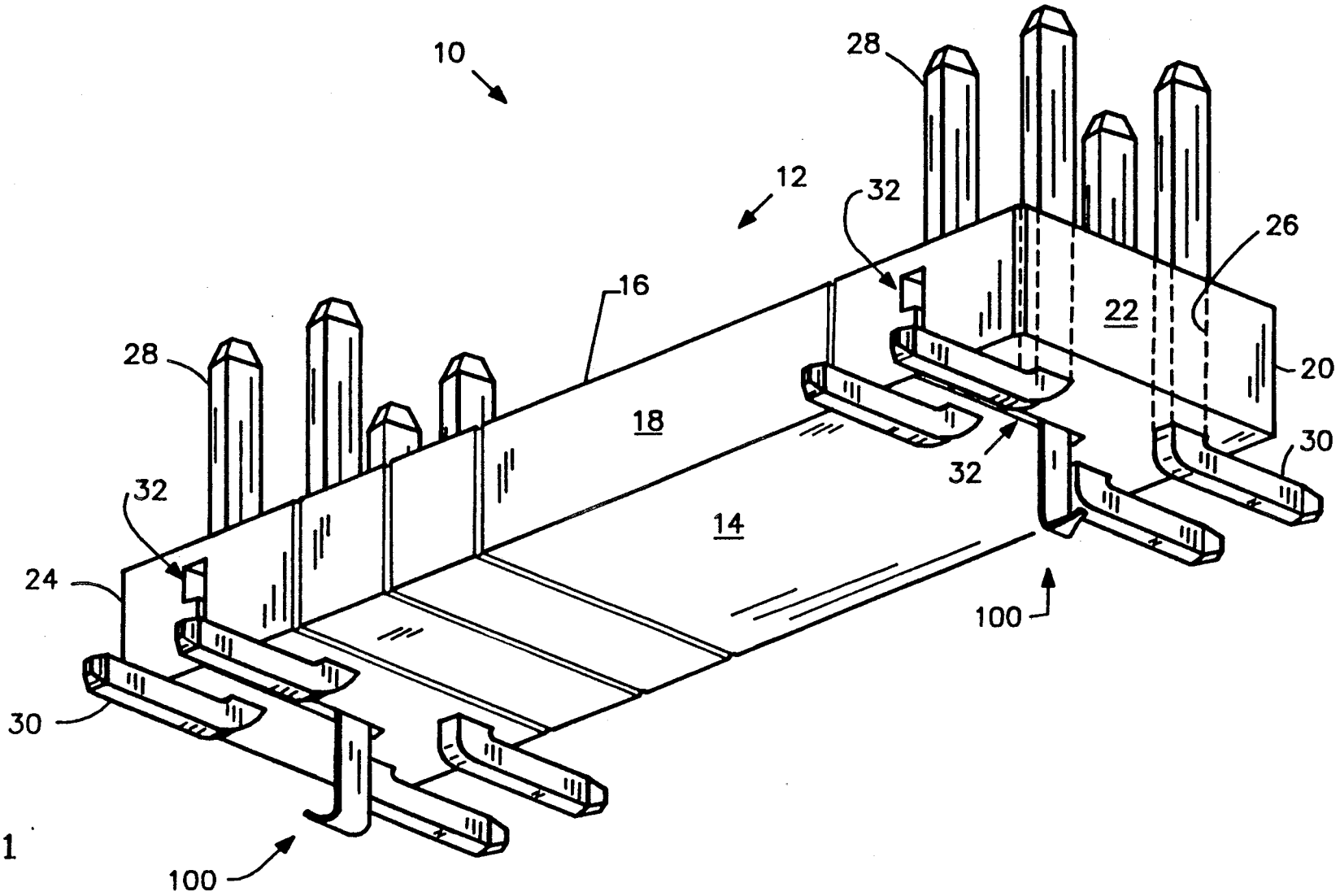
FIG. 1 is a perspective view of an electrical connector with a pair of fish hook hold-downs in accordance with the present invention.

Throughout the following detailed description, similar reference characters refer to similar elements in all figures of the drawings.

Referring to FIG. 1, there is a perspective view of an electrical connector 10 with a pair of fish hook hold-downs 100 for holding the connector 10 to a circuit assembly in accordance with the present invention.

Although the fish hook hold-downs 100 can be used to secure surface-mount connectors or through-mount connectors to circuit assemblies, the connector 10 illustrated in FIG. 1 is a surface-mount connector.

The connector 10 has a dielectric housing 12 with a first mating surface 14, a second mating surface 16, a first elongated side surface 18, a second elongated side surface 20, a first end surface 22 and a second end surface 24. A plurality of passages 26 extend in rows and columns through the housing 12 from the first mating surface 14 to the second mating surface 16. A plurality of electrical terminals 28 are mounted in the passages 26. The terminals 28 are surface-mount terminals having end portions 30 extending out of the passages 26 through the first mating surface 14 arranged in rows and columns for electrically contacting and soldering to conductive pads on a circuit assembly.

Figure 5:
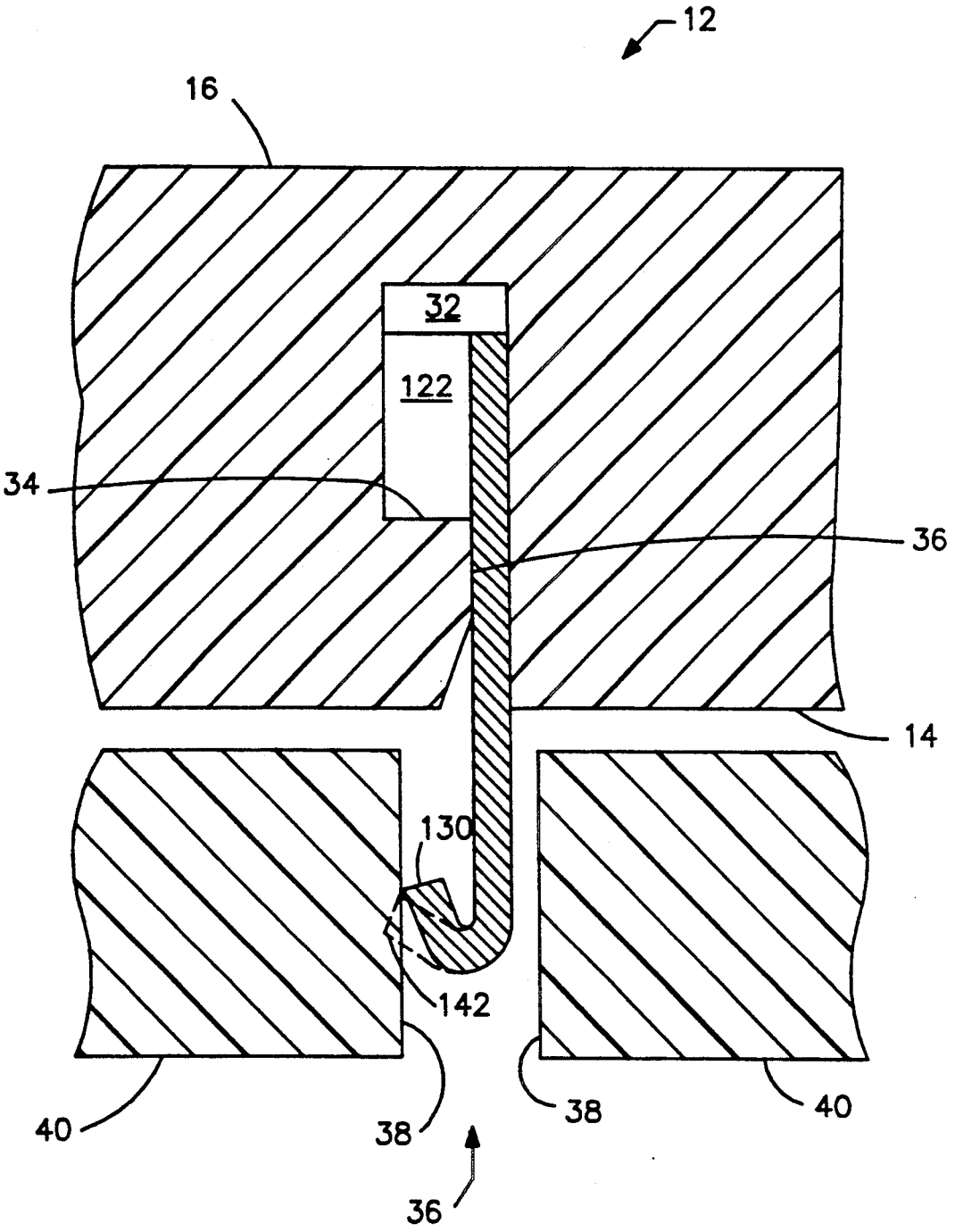
FIG. 5 is a cross sectional view of the fish hook hold-down of FIG. 2 interconnecting a connector housing and a printed circuit board.

The housing 12 has a hold-down receiving space 32 is recessed in the first mating surface 14 and the first side surface 18. Referring to FIG. 5, the space 32 is partially defined by a shoulder surface 34 generally parallel to the first mounting surface 14. The shoulder surface 34 extends the entire width of the space 32. This shoulder surface 34 can be described as the top surface of a step which has only one other surface 36 exposed or partially defining the space 32.

Figure 4:
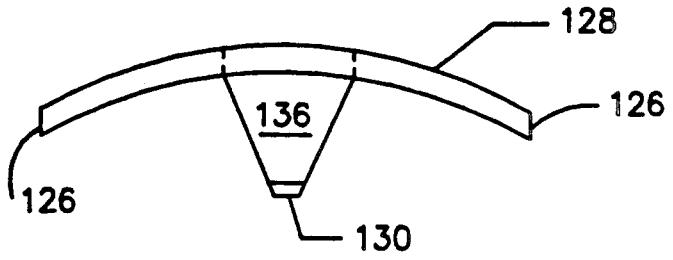
FIG. 4 is a top or plan view of the fish hook hold-down of FIG. 2.
Figure 2:
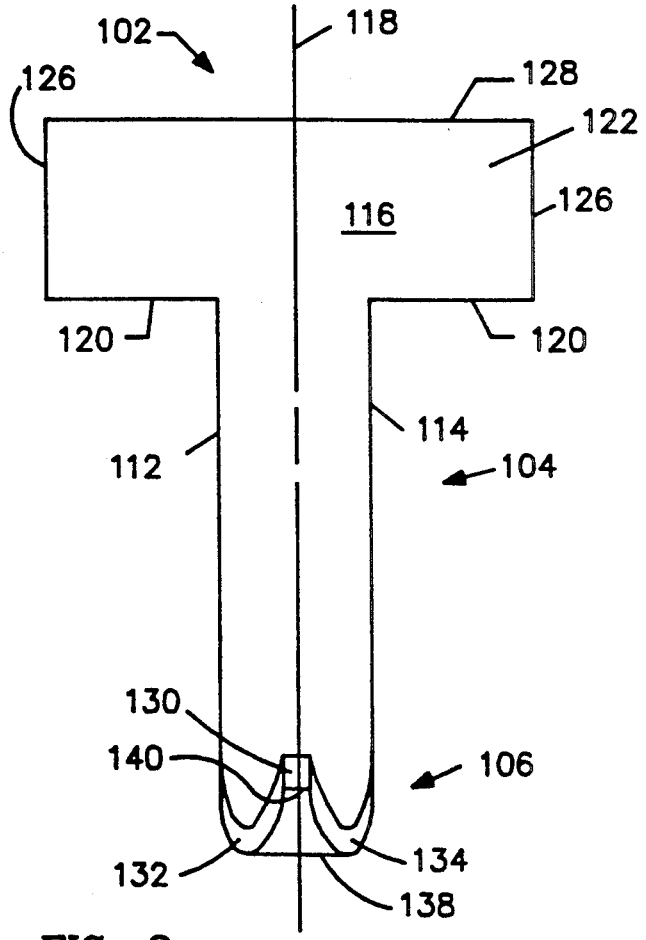
FIG. 2 is a front side view of a first embodiment of a fish hook hold-down in accordance with the present invention.
Figure 3:
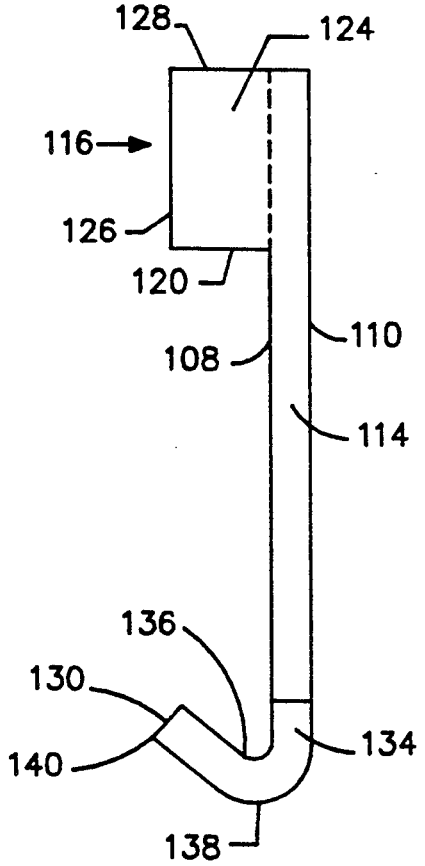
FIG. 3 is a right side view of the fish hook hold-down of FIG. 2.

Referring to FIGS. 2, 3 and 4, the fish hook hold-down 100 generally comprises a housing attaching portion 102, a substantially flat elongated strip 104 and a circuit assembly attaching portion 106. The housing attaching portion 104, the substantially flat elongated strip 106 and the circuit assembly attaching portion 106 are made from one-piece of material.

The substantially flat elongated strip 104 is connected to the housing attaching portion 102. The strip 104 has a first elongated substantially flat side 108, a second elongated substantially flat side 110, a first elongated flat edge 112 and a second elongated flat edge 114. The edges 112,114 interconnect the sides 108,110.

The housing attaching portion 102 is for securing to the connector housing 12. The housing attaching portion 102 comprises a curved strip 116 extending laterally away from a longitudinal axis 118 of the flat elongated strip 104 from the first elongated flat edge 112 and extending laterally away from the longitudinal axis 118 of the flat elongated strip 104 from the second elongated flat edge 114. The curved strip 116 has a pair of flat abutment edges 120 generally facing the circuit assembly attaching portion 106. The abutment edges 120 are for contacting the shoulder surface 34 partially defining the hold-down receiving space 32 in the connector housing 12. See FIG. 5. The curved strip 116 further comprises an inner cylindrical surface 122, an outer cylindrical surface 124, a pair of flat edges 126 generally parallel to the first and second elongated flat edges 112,114 of the flat elongated strip 104, and a flat elongated edge 128 generally parallel to the pair of flat abutment edges 120.

The circuit assembly attaching portion 106 is connected to the elongated strip 104. The circuit assembly attaching portion 106 is for securing to the circuit assembly. The circuit assembly attaching portion 106 comprises an end portion of the strip 104 folded to have a fish hook configuration. The circuit assembly attaching portion 106 comprises a flat tip 130, a first tapered flat edge 132, a second tapered flat edge 134, a bent elbow inner surface 136 and a bent elbow outer surface 138. The first tapered flat edge 132 intersects the flat tip 130 and the first elongated flat edge 112. The second tapered flat edge 134 intersects the flat tip 130 and the second elongated flat edge 114. The bent elbow inner surface 136 intersects the flat tip 130, the first elongated flat side, 108 the first tapered flat edge 132 and the second tapered flat edge 134. The bent elbow outer surface 138 intersects the flat tip 130 forming a linear barb 140. The bent elbow outer surface 138 further intersects the second elongated flat side 110, the first tapered flat edge 132 and the second tapered flat edge 134.

Figure 6:
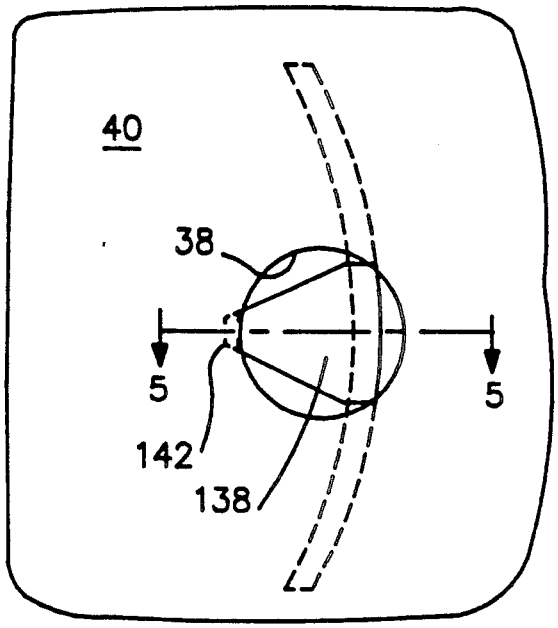
FIG. 6 is a bottom side view of the assembly of FIG. 5.

FIG. 5 illustrates a cross sectional view of the fish hook hold-down of FIG. 2 interconnecting the connector housing and a printed circuit board. FIG. 6 is a bottom side view of the assembly of FIG. 5. FIG. 5 is a cross sectional view taken generally along the line 5—5 in FIG. 6 in the direction of the arrows.

Referring to FIGS. 1 and 5, the housing attaching portion 102 of the fish hook hold-down 100 is first forced into the space 32 through the first elongated side surface 18. The hold-down 110 is held in the space 32 by an interference fit between the curved strip 116 and the housing 12 defining the space 32. Then the circuit assembly attaching portion 106 is forced into a hole 36 defined by a cylindrical wall 38 through the circuit assembly 40 such that the bent elbow outer surface 138 is inserted first into the hole 36, the bent elbow outer surface 138, the first tapered flat edge 132 and the second tapered flat edge 134 contact the cylindrical wall 38 forcing the tip 130 towards the flat elongated strip 104 causing an interference fit within the hole 36. The non-compressed state position of the circuit assembly attaching portion 106 is generally illustrated by dashed lines 142. If the fish hook hold-down 100 is then forced in a direction opposite to the insertion direction, the linear barb 140 digs into the cylindrical wall 38 significantly deterring withdrawal.

Figure 7:
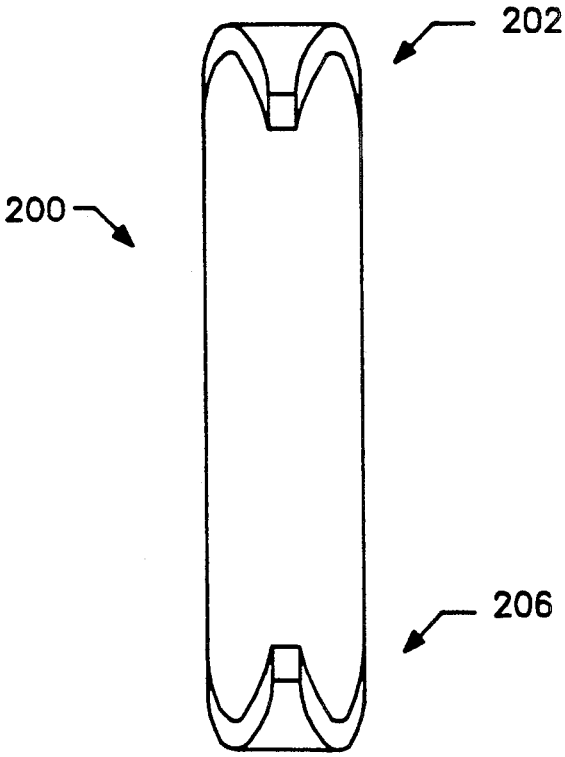
FIG. 7 is a front side view of a second embodiment of a fish hook hold-down in accordance with the present invention.
Figure 8:
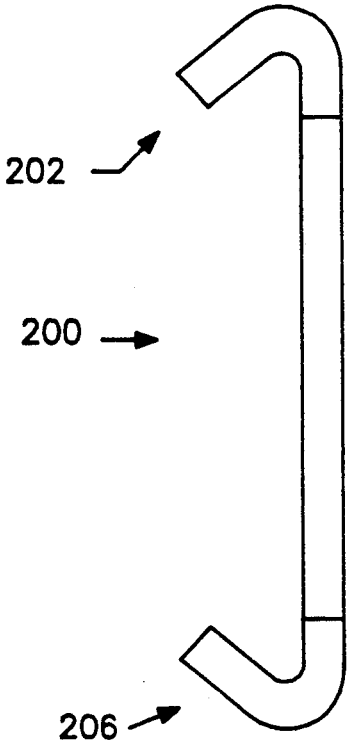
FIG. 8 is a right side view of the fish hook hold-down of FIG. 7.

Referring to FIGS. 7 and 8, there is illustrated a second embodiment of a fish hook hold-down 200 in accordance with the present invention. This fish hook hold-down 200 is the same as the first fish hook hold-down 100, except the hold-down 200 comprises a housing attaching portion 202 which is a mirror image of its circuit assembly attaching portion 206 which is identical to the circuit assembly attaching portion 106 of the first fish hook hold-down 100.

The hold-downs of the present invention can be used to ground the connector to the assembly. Typically, the hold-down terminals will be in addition to and distinct from the electrical contact elements used as signal paths.

The hold-downs terminals or hold-downs of the present invention can be made from any suitable metal used for making hold-downs, such as stainless steel. Further, the hold-downs can be made from any suitable metal used for making electrical terminals, such as brass, phosphor bronze, beryllium copper and the like. The hold-down may be plated or coated with a layer, such as tin, lead, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A fish hook hold-down for holding a connector housing to a circuit assembly, comprising:

a housing attaching portion for securing to the connector housing;

a substantially flat elongated strip connected to the housing attaching portion, the strip having a first elongated substantially flat side, a second elongated substantially flat side, a first elongated flat edge and a second elongated flat edge, the edges interconnecting the sides; and a circuit assembly attaching portion connected to the elongated strip, the circuit assembly attaching portion for securing to the circuit assembly, the circuit assembly attaching portion comprising an end portion of the strip folded to have a fish hook configuration comprising: a flat tip whose width is less than the width of the elongated strip, a first tapered flat edge intersecting the flat tip and the first elongated flat edge, a second tapered flat edge intersecting the flat tip and the second elongated flat edge, a bent elbow inner surface intersecting the flat tip, the first elongated flat side, the first tapered flat edge and the second tapered flat edge, and a bent elbow outer surface intersecting the flat tip and forming therewith a linear barb, the bent elbow outer surface further intersecting the second elongated flat side, the first tapered flat edge and the second tapered flat edge, whereby when the fish hook hold-down is forced in an insertion direction into a hole defined by a cylindrical wall through the circuit assembly such that the bent elbow outer surface is inserted first into the hole, the bent elbow outer surface, the first tapered flat edge and the second tapered flat edge contact the cylindrical wall forcing the tip towards the flat elongated strip causing an interference fit within the hole, but if the fish hook hold-down is then forced in a direction opposite to the insertion direction, the linear barb digs into the cylindrical wall significantly deterring withdrawal.

2. The fish hook hold-down of claim 1, wherein the housing attaching portion, the substantially flat elongated strip and the circuit assembly attaching portion are one-piece.

3. The fish hook hold-down of claim 1, wherein the housing attaching portion comprises a curved strip extending laterally away from a longitudinal axis of the substantially flat elongated strip from the first elongated flat edge and extending laterally away from the longitudinal axis of the flat elongated strip from the second elongated flat edge, the curved strip having a pair of flat abutment edges generally facing the circuit assembly attaching portion, the abutment edges for contacting a shoulder surface partially defining a hold-down receiving space recessed in a mounting face of the connector housing.

4. The fish hook hold-down of claim 3, wherein the curved strip further comprises an inner cylindrical surface, an outer cylindrical surface, a pair of flat edges generally parallel to the first and second elongated flat edges of the flat elongated strip, and a flat elongated edge generally parallel to the pair of flat abutment edges.

5. The fish hook hold-down of claim 1, wherein the housing attaching portion comprises a mirror image of the circuit assembly attaching portion.

6. An electrical connector for mounting to a circuit assembly, comprising:

a dielectric housing having a mounting face and a hold-down receiving space recessed in the mounting face, the space partially defined by a shoulder surface generally parallel to the mounting face; and at least one fish hook hold-down having:

a housing attaching portion for inserting into the recessed space and securing to the connector housing;

a substantially flat elongated strip connected to the housing attaching portion, the strip having a first elongated substantially flat side, a second elongated substantially flat side, a first elongated flat edge and a second elongated flat edge, the edges interconnecting the sides; and a circuit assembly attaching portion connected to the elongated strip, the circuit assembly attaching portion for securing to the circuit assembly, the circuit assembly attaching portion comprising an end portion of the strip folded to have a fish hook configuration comprising: a flat tip whose width is less than the width of the elongated strip, a first tapered flat edge intersecting the flat tip and the first elongated flat edge, a second tapered flat edge intersecting the flat tip and the second elongated flat edge, a bent elbow inner surface intersecting the flat tip, the first elongated flat side, the first tapered flat edge and the second tapered flat edge, and a bent elbow outer surface intersecting the flat tip and forming therewith a linear barb, the bent elbow outer surface further intersecting the second elongated flat side, the first tapered flat edge and the second tapered flat edge, whereby when the fish hook hold-down is forced in an insertion direction into a hole defined by a cylindrical wall through the circuit assembly such that the bent elbow outer surface is inserted first into the hole, the bent elbow outer surface, the first tapered flat edge and the second tapered flat edge contact the cylindrical wall forcing the tip towards the flat elongated strip causing an interference fit within the hole, but if the fish hook hold-down is then forced in a direction opposite to the insertion direction, the linear barb digs into the cylindrical wall significantly deterring withdrawal.

7. The fish hook hold-down of claim 6, wherein the housing attaching portion, the substantially flat elongated strip and the circuit assembly attaching portion are one-piece.

8. The fish hook hold-down of claim 6, wherein the housing attaching portion comprises a curved strip extending laterally away from a longitudinal axis of the substantially flat elongated strip from the first elongated flat edge and extending laterally away from the longitudinal axis of the flat elongated strip from the second elongated flat edge, the curved strip having a pair of flat abutment edges generally facing the circuit assembly attaching portion, the abutment edges for contacting the shoulder surface of the connector housing.

9. The fish hook hold-down of claim 8, wherein the curved strip further comprises an inner cylindrical surface, an outer cylindrical surface, a pair of flat edges generally parallel to the first and second elongated flat edges of the flat elongated strip, and a flat elongated edge generally parallel to the pair of flat abutment edges.

10. The fish hook hold-down of claim 6, wherein the housing attaching portion comprises a mirror image of the circuit assembly attaching portion.

* * * * *